US006491467B1

(12) United States Patent
Mitsuya

(10) Patent No.: US 6,491,467 B1
(45) Date of Patent: Dec. 10, 2002

(54) WRITING INSTRUMENT

(75) Inventor: Yoshihide Mitsuya, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 09/981,910

(22) Filed: Oct. 19, 2001

(51) Int. Cl.[7] ..... B43K 29/00
(52) U.S. Cl. ..... 401/195; 401/6
(58) Field of Search ..... 401/195, 6, 221, 401/52, 99

(56) References Cited

U.S. PATENT DOCUMENTS 4,569,524 A * 2/1986 Quijano ..... 273/173
5,664,440 A * 9/1997 Roemer ..... 63/15
5,945,051 A 8/1999 Asahara
6,164,751 A * 12/2000 Griffin et al. ..... 347/28
6,244,772 B1 * 6/2001 Ruchonnet ..... 401/195

FOREIGN PATENT DOCUMENTS

JP 10-17378 1/1998

* cited by examiner

*Primary Examiner*—David J. Walczak
(74) *Attorney, Agent, or Firm*—McGinn & Gibb, PLLC

(57) ABSTRACT

A writing instrument, includes a writing instrument body, and a tourmaline-containing member containing tourmaline. The tourmaline-containing member is mounted on the writing instrument body such that a surface of the member is exposed.

6 Claims, 3 Drawing Sheets

WRITING INSTRUMENT

BACKGROUND OF THE INVENTION

1. Field of the Invention

The present invention relates to a writing instrument such as a mechanical pencil, a ball-point pen, or a computer-input pen, and more particularly to a writing instrument whose added value is further improved.

2. Description of the Related Art

Recently, a conventional writing instrument has been frequently used together with a computer system in its operation mode, and thus has been exposed to electromagnetic waves generated by a monitor of the computer system. Therefore, users of such a writing instrument under such a condition have suffered reportedly from asthenopia, stiff shoulder, headache, or giddiness due to exposure to the electromagnetic waves. This is problematic.

Moreover, while various means have been developed to prevent damage due to electromagnetic waves, it has not been considered to implement such means for (or in) a writing instrument.

SUMMARY OF THE INVENTION

In view of the foregoing and other problems, drawbacks, and disadvantages of the conventional structures, an object of the present invention is to provide a writing instrument capable of moderating influences due to electromagnetic waves and improving the added value.

In a first aspect of the present invention, a tourmaline-containing member containing tourmaline is mounted on a writing instrument of the present invention so that a surface of the tourmaline-containing member is exposed to the ambient. Tourmaline is also referred to as DENKI-ISHI (e.g., "electric stone") in Japanese that is an ore of a "polar crystal". When the tourmaline contacts with moisture (e.g., $H_2O$) contained in air, it produces negative ions and is effective for reducing positive ions produced by electromagnetic waves.

Therefore, by mounting a tourmaline-containing member containing tourmaline on a writing instrument, the influence of electromagnetic waves on a user can be moderated.

Moreover, a feeble (small) current flows though the body of the user holding the writing instrument as the tourmaline has natural polarization and provides a stimulus for the user holding a writing instrument. Then, the stimulus is transmitted to the nervous system of the human body to activate metabolism and blood circulation of the user. Furthermore, because the tourmaline produces negative ions, the user may be relaxed.

Furthermore, because the tourmaline has a pyroelectric effect and a piezoelectric effect (and thereby these energies are inverted into far infrared radiation), the user's body may be warmed.

Hence, because the tourmaline is disposed near the user's body not only when writing is performed by holding the writing instrument, but also when putting the instrument into the user's pocket, the tourmaline's effects can be sufficiently obtained.

The tourmaline-containing member may be formed into any shape. However, when the exposed surface of the tourmaline-containing member is spherically formed, a contact area is increased between the tourmaline-containing member and air even if the tourmaline-containing member has a small-volume.

Moreover, the tourmaline-containing member may be formed into a spherical shape and a part of the sphere may be embedded into a curved concave portion formed on a part of a writing instrument. Therefore, the tourmaline-containing member may be stably held and embedded in the curved concave portion without considering a setting direction of the tourmaline-containing member when embedding the same.

The tourmaline-containing member may be formed by molding powder of the tourmaline, and, if necessary, a tourmaline-exciting agent, and base materials such as a resin, into a desired shape. Moreover, it is possible to attach material including powder of the tourmaline and, if necessary, a tourmaline-exciting agent, to a molding obtained by molding a base material such as a resin, with application or coating.

The tourmaline-containing member may be mounted on any position of the writing instrument, particularly to the clip or rear end of the writing instrument. For example, it is possible to set the member to a base of the clip or a longitudinal middle portion or front end portion of the clip. To derive sufficient effects of the tourmaline, preferably a volume of the tourmaline-containing member is increased to a certain extent.

However, in the case of the writing instrument, it is difficult to find a space for housing a bulky member without disturbing a writing medium. If the tourmaline-containing member is mounted on the base of the clip, then it can be securely held there because the base of the clip has a thick wall to connect the clip with the writing instrument body so that the wall is thick enough to accommodate the tourmaline-containing member. In contrast, if the tourmaline-containing member is mounted on the longitudinal middle portion or front end portion of the clip, then it can be held there by using a gap formed between the clip and the writing instrument body. Furthermore, by mounting the tourmaline-containing member on the clip or rear end of a writing instrument, the effects of the tourmaline may be derived because the member is exposed to the atmosphere even if the writing instrument is placed in the user's pocket.

Furthermore, the tourmaline-containing member can be a grip made of a soft material to be mounted on a gripped portion of the writing instrument. In this case, when the writing instrument is used, the grip receives a gripping force from a user and a strain of the tourmaline crystal is increased by the user's grip. Therefore, the grip is electrified and various effects of the tourmaline such as the negative-ion generation effect and the far-infrared radiation effect by a piezoelectric phenomenon are more effectively derived.

Furthermore, applying the present invention to a computer-input pen is particularly advantageous because there is a large influence due to electromagnetic waves around a computer system.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS OF THE PRESENT INVENTION

Embodiments of the present invention are described below by referring to the accompanying drawings.

First Embodiment

Figure 1:
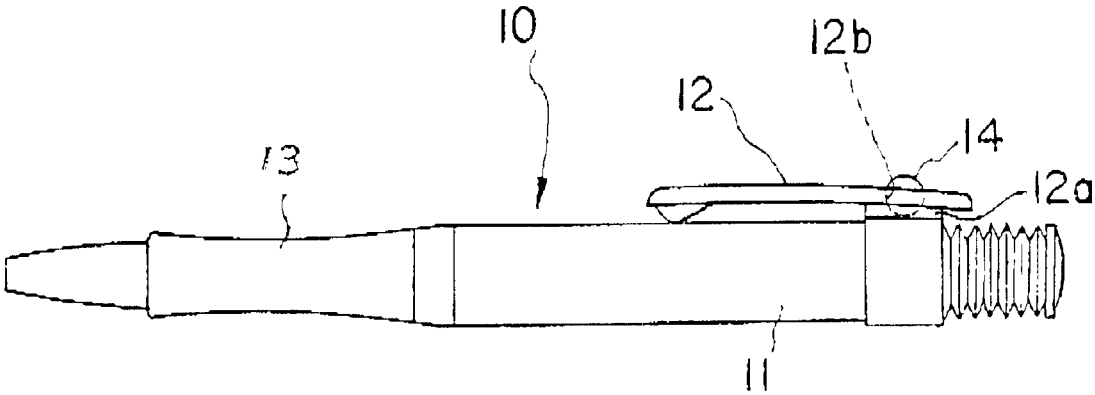
FIG. 1 is a side view showing a first embodiment of a writing instrument 10 of the present invention.
Figure 2:
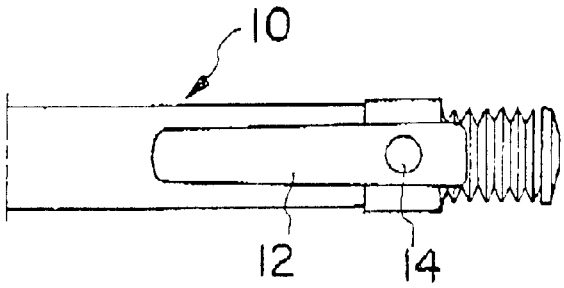
FIG. 2 is a plan view of an essential portion of the writing instrument 10 of the present invention shown in FIG. 1.

FIGS. 1 and 2 are illustrations showing a first embodiment of a writing instrument 10 of the present invention. A clip 12 of the writing instrument 10 is provided with a tourmaline-containing member 14.

Preferably, the tourmaline-containing member 14 is spherical and a part of the spherical member is embedded in a curved concave portion 12*b* formed on a base 12*a* of the clip 12 and fixed by, for example, an adhesive. Preferably, the tourmaline-containing member 14 is molded as a desirable spherical porous member in accordance with the method disclosed in Japanese Patent Laid-Open No. Hei 10-17378.

To derive sufficient effects of the tourmaline, preferably the tourmaline-containing member 14 makes contact with air. Because the outer surface of the tourmaline-containing member 14 protruding from the writing instrument 10 is spherical, a large surface area is provided even if the member 14 has a small volume, and thus the writing instrument can obtain sufficient tourmaline effects.

Because the tourmaline-containing member 14 is spherical, a part of the member 14 may be embedded in the curved concave portion 12*b* and may be bonded to the portion 12*b* independently of its setting direction, thereby to improve the working efficiency in assembly. Moreover, to connect the clip 12 with a writing instrument body 11, the tourmaline-containing member 14 is preferably mounted on the base 12*a* where a thickness of the clip 12 is increased. Therefore, a large amount of the outer surface area of the curved concave portion 12*b* can be increased (provided), thereby enhancing a holding force between the curved concave position 12*b* and the tourmaline-containing member 14.

Second Embodiment

Figure 3:
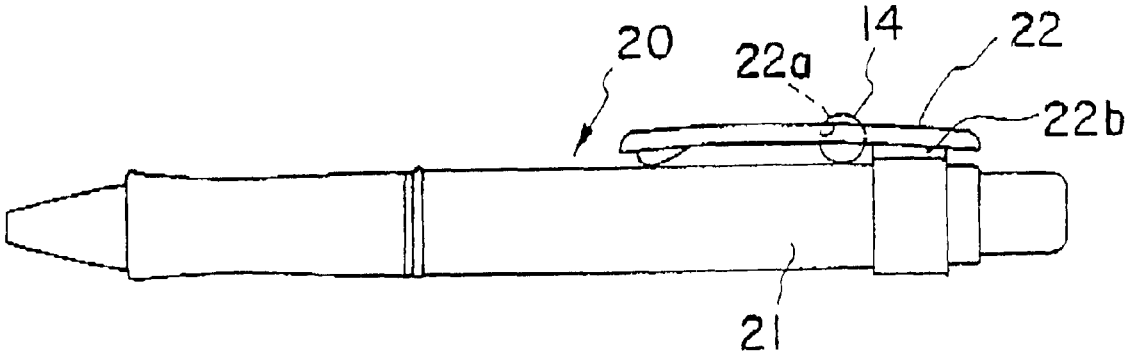
FIG. 3 is a side view showing a second embodiment of a writing instrument 20 of the present invention.
Figure 4:
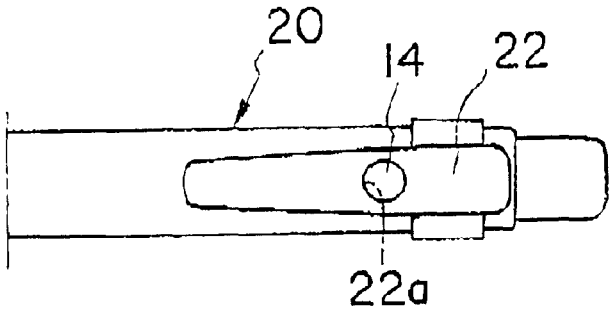
FIG. 4 is a plan view of an essential portion of the writing instrument 20 of the present invention shown in FIG. 3.

FIGS. 3 and 4 are illustrations showing a second embodiment of a writing instrument 20 according to the present invention.

In this exemplary embodiment, the tourmaline-containing member 14 is mounted on an intermediate (e.g., middle) portion in a longitudinal direction of a clip 22 of the writing instrument 20. A through hole 22*a* is provided in the corresponding portion of the clip 22.

A portion of the tourmaline-containing member 14 is fitted into the through hole 22*a* such that the spherical-shaped tourmaline-containing member 14 projects from the through hole 22*a*, and the tourmaline-containing member 14 is held between the through hole 22*a* and a writing instrument body 21 of the writing instrument 20.

The clip 22 is mounted on the writing instrument body 21 with the tourmaline-containing member 14 being fitted on the backside of the clip 22 into the through hole 22*a*. Hence, the tourmaline-containing member 14 is mounted on the writing instrument 20 with the clip 22. Thus, the necessity for attaching the tourmaline-containing material 14 with an adhesive can be eliminated.

In the second embodiment, the tourmaline-containing member 14 is exposed to the atmosphere in its portion projecting outwardly from the through hole 22*a* and in its portion between the clip 22 and the writing instrument body 21, thereby providing adequate effects of the tourmaline. A holding space for securing the tourmaline-containing member 14 is ensured by using space formed between the clip 22 and the writing instrument body 21.

While the tourmaline-containing member 14 may be in any location in the longitudinal direction of the clip 22, the location is preferably near the base 22*b* since it provides better stability and the tourmaline-containing member 14 does not interfere with inserting the writing instrument into a user's pocket (e.g., with the pocket being between the clip 22 and the writing instrument body 21).

Third Embodiment

Figure 5:
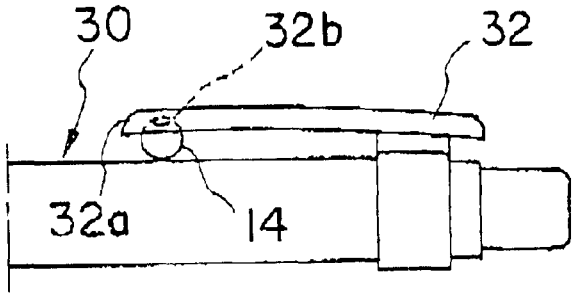
FIG. 5 is a side view of an essential portion showing a third embodiment of a writing instrument 30 of the present invention.

FIG. 5 shows a third embodiment of a writing instrument 30 according to the present invention.

In this exemplary embodiment, the tourmaline-containing member 14 is mounted on the front end 32*a* of a clip 32 of the writing instrument 30. That is, a curved concave portion 32*b* is formed on the front end 32*a* of the clip 32 and a part of the tourmaline-containing member 14 is embedded in the curved concave portion 32*b* and fixed by an adhesive. Because the portion of the tourmaline-containing member 14 protruding from the clip 32 is exposed to air, a sufficient tourmaline effect can be obtained.

With this embodiment, because the tourmaline-containing member 14 is mounted on the front end 32*a* of the clip 32, the member 14 can be used as a holding protrusion when positioning a pocket of a user's coat/shirt between the clip 32 and the writing instrument 30.

Fourth Embodiment

Figure 6:
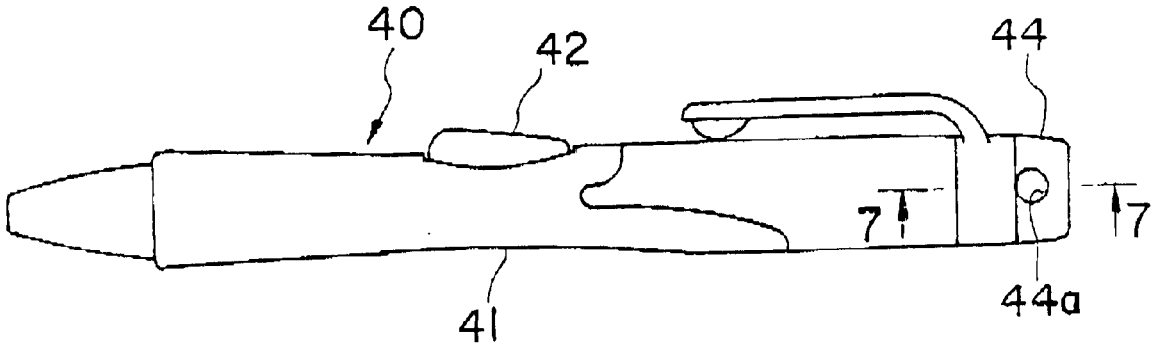
FIG. 6 is a side view of a fourth embodiment of a writing instrument 40 of the present invention.
Figure 7:
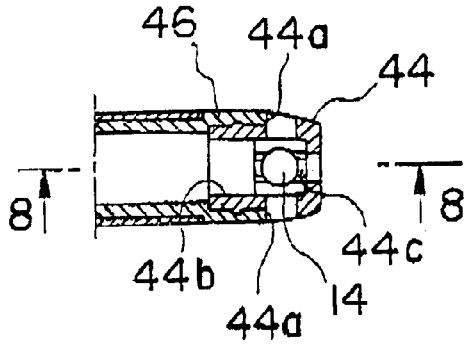
FIG. 7 is a sectional view taken along the line 7—7 in FIG. 6.
Figure 8:
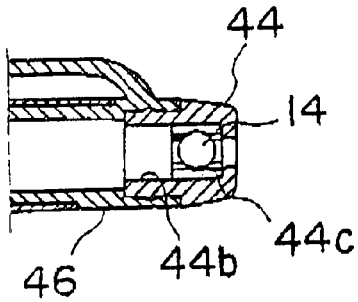
FIG. 8 is a sectional view taken along the line 8—8 in FIG. 7.

FIGS. 6–8 are illustrations showing the fourth embodiment of a writing instrument 40 according to the present invention.

In this exemplary embodiment, the tourmaline-containing member 14 is mounted on the rear end of the writing instrument 40. The writing instrument 40 is a so-called "side-knock-type" writing instrument in which an operating member 42 is provided on a side face of a writing-instrument body 41 and a writing medium advances from or retracts into a front end of the writing instrument body 41.

Moreover, a rear-end cap 44 constituting the rear end of the writing instrument 40 is provided on the rear end of the writing-instrument body 41. Two lateral concavities (e.g., holes) 44*a* circumferentially facing each other are formed on the rear-end cap 44 and each concavity 44*a* communicates with a central through-hole 44*b* of the rear-end cap 44. A plurality of ribs 44*c* are formed on the inner periphery of the central through-hole 44*b* and the tourmaline-containing member 14 is press-fitted into the central through-hole 44*b* so as to forcibly contact with the ribs 44*c*.

The rear-end cap 44 is fixed by being press-fitted to a component 46 constituting the writing-instrument body 41.

In the writing instrument 40, the tourmaline-containing member 14 is exposed to air through the concavities 44*a* and central through-hole 44*b*. Therefore, a sufficient tourmaline effect can be obtained. Moreover, a space for housing the tourmaline-containing member 14 can be provided by using an empty space of the rear-end cap 44 independently of advancing/retracting of a writing medium.

Though this embodiment shows an example of a side-knock-type writing instrument, it is, of course, possible to apply the present invention to a so-called "rear-end-knock-type" writing instrument in which a writing medium advances from or retracts into the body by knocking the rear end of the writing instrument. In this case, a tourmaline-containing member may be housed in a rear-end knock cap.

In another example, a concave portion may be formed on the rear end surface of the rear end of the rear end cap of the writing instrument, or the like, and a portion of the tourmaline-containing member may be embedded into the concave portion, the remaining portion of the tourmaline-containing member can be rearwardly projected.

Moreover, as another example, a grip 13 may be formed to be mounted on a gripped portion of a writing instrument to be held by a user in FIG. 1 by a tourmaline-containing member. The grip may be formed by adding tourmaline powder to a soft material mainly made of rubber, synthetic rubber, or thermoplastic elastomer or by attaching material including tourmaline powder and, if necessary, tourmaline-exciting agent to the soft material with application or coating. As such the tourmaline could be integrally formed with the grip (or, for that matter, another component of the writing instrument). Because the grip receives a gripping force from a user, a strain of the tourmaline crystal is increased by the gripping force and thereby it is electrified and various effects of tourmaline including the negative-ion generation effect and far-infrared-generation effect by a piezoelectric phenomenon are more effectively derived.

As described above, the present invention can moderate the influence of electromagnetic waves when using a writing instrument under an environment exposed to electromagnetic waves by applying a tourmaline-containing member to the writing instrument. Moreover, it is thereby possible to obtain a writing instrument having a high added value.

While the invention has been described in terms of several preferred embodiments, those skilled in the art will recognize that the invention can be practiced with modification within the spirit and scope of the appended claims.

For example, while the embodiments above have related to applying the tourmaline to a writing instrument, the present invention would be equally advantageous in any hand-held instrument or input device exposed to an electromagnetic-wave-environment such as a light pen, a touch pad, a joystick, a keyboard, a mouse, etc. Thus, the tourmaline may be added to such devices in the manner described above and the effects of the present invention would be provided.

What is claimed is:

1. A handheld writing instrument including a writing medium, comprising:

a handheld writing instrument body associated with said writing medium; and a tourmaline-containing member containing tourmaline, said tourmaline-containing member being mounted on the handheld writing instrument body such that a surface of the member is exposed from an external surface of said handheld writing instrument body.

2. The writing instrument according to claim 1, wherein the exposed surface of the tourmaline-containing member is spherical.

3. The writing instrument according to claim 1, wherein the tourmaline-containing member is spherical and a part of the member is embedded in a curved concave portion formed on a component of the writing instrument.

4. The writing instrument according to claim 1, wherein the writing instrument includes a clip, said tourmaline-containing member being mounted on the clip.

5. The writing instrument according to claim 1, wherein the writing instrument has a rear end and a front end, wherein the tourmaline-containing member is mounted on the rear end of the writing instrument.

6. The writing instrument according to claim 1, wherein the tourmaline-containing member comprises a grip mounted on a gripped portion of the writing instrument.

* * * * *